US006412664B1

(12) United States Patent
Wolff et al.

(10) Patent No.: US 6,412,664 B1
(45) Date of Patent: Jul. 2, 2002

(54) CAP FOR DISPENSING VISCOUS LIQUIDS

(76) Inventors: Floyd Wolff, PMB 416, 5030 Champion Blvd., Boca Raton, FL (US) 33496; Steven Wolff, 201 E. 69th St., New York, NY (US) 10021

( * ) Notice: Subject to any disclaimer, the term of this patent is extended or adjusted under 35 U.S.C. 154(b) by 0 days.

(21) Appl. No.: 09/640,455

(22) Filed: Aug. 17, 2000

(51) Int. Cl.[7] ..... B65D 37/00

(52) U.S. Cl. ..... 222/211; 222/464.1; 222/564; 222/547; 222/556; 220/259; 220/837; 215/235

(58) Field of Search ..... 222/464.1, 211, 222/212, 556, 564, 546, 547; 220/254, 259, 837, 847; 215/235, 237; 210/244, 248

(56) References Cited

U.S. PATENT DOCUMENTS

| | | | | | |
|---|---|---|---|---|---|
| 4,170,315 | A | * | 10/1979 | Dubach et al. | 220/281 |
| 4,187,964 | A | * | 2/1980 | Bogart | 222/546 |
| 4,949,883 | A | * | 8/1990 | Dubach | 222/556 |
| 5,067,624 | A | * | 11/1991 | Thanisch | 215/235 |
| 5,169,035 | A | * | 12/1992 | Imbery, Jr. | 222/212 |
| 5,460,282 | A | * | 10/1995 | Giblin et al. | 215/260 |
| 5,497,906 | A | * | 3/1996 | Dubach | 222/23 |
| 5,782,388 | A | * | 7/1998 | De Nervo | 222/546 |
| 5,865,353 | A | * | 2/1999 | Baudin | 222/546 |
| 5,865,354 | A | * | 2/1999 | Bansal | 222/546 |

FOREIGN PATENT DOCUMENTS

| | | | | |
|---|---|---|---|---|
| FR | WO-88/01972 | * | 3/1988 | B65D/47/08 |
| GB | 2224309 A | * | 5/1990 | B65D/47/08 |
| GB | 2278837 A | * | 12/1994 | B65D/47/08 |

* cited by examiner

*Primary Examiner*—Henry C. Yuen
*Assistant Examiner*—Frederick Nicolas
(74) *Attorney, Agent, or Firm*—Robert R Deleault, Esq.; Mesmer & Deleault, PLLC

(57) ABSTRACT

A cap for use in dispensing viscous liquids from containers without the accompaniment of lower viscosity liquid present in the container. The cap has a top portion with an outside surface and an inside surface and an elongated conduit formed at a pre-determined angle. The elongated conduit has an outlet and an inlet. The outlet is situated either eccentrically or concentrically on the outside surface of the top portion such that at least one point on the circumference of the top portion is greater than 10 millimeters from the edge of the inlet.

15 Claims, 4 Drawing Sheets

CAP FOR DISPENSING VISCOUS LIQUIDS

BACKGROUND OF THE INVENTION

1. Field of the Invention

The present invention relates generally to caps for dispensing viscous liquids from flexible plastic containers. More particularly, the present invention relates to caps for dispensing viscous liquids without the accompaniment of lower viscosity liquid present in the container. Even more particularly, the present invention relates to caps for dispensing viscous liquids without lower viscosity liquid while simultaneously preventing accumulation of viscous liquids under the lid.

2. Description of the Prior Art

There are many different types of packaging for viscous liquids such as ketchup, mustard, shampoo, and body cream. It is common to use a plastic cap for dispensing viscous liquids from flexible plastic containers. Some caps have threaded inner walls so that they may be screwed onto the container. Other caps snap into the top of the container. These caps have single or multiple openings for dispensing the viscous liquid. Some have a recessed area around the opening on the underside of the lid. Others include a convex or concave projection to assist in dispensing the viscous liquid.

Two types of dispensing package for viscous liquids, as seen in U.S. Pat. Nos. 5,071,039 and 5,125,541, allow the user to dispense a measured quantity of viscous liquid. These packages are comprised of a reservoir for holding the viscous liquid inside the container, a channel for measuring the quantity of viscous liquid to be dispensed, a spout for the viscous liquid to exit the package, and an air trap to replenish the package with air. Viscous liquids are difficult to measure and pour. These packages are designed to alleviate this problem with an inexpensively produced package. They can, for example, measure and dispense a quantity of honey with sweetness equal to one teaspoon of sugar. These packages do not, however, address the problem of lower viscosity liquid discharge.

In another type of package for dispensing viscous liquids, there are recessed areas for collecting excess water and other debris to prevent contamination of the viscous liquid within the container, as shown in U.S. Pat. No. 5,411,182. The recesses are in the form of concentric rings extending from the center of the dispenser toward the outward edge. The outermost edge of the rings scrapes the sides of the container to prevent accumulation of the viscous liquid on the inside of the container. This invention was intended for use in dispensing viscous liquids intended for personal hygiene. It dispenses many small streams of viscous liquid from the holes in its surface rather than the single stream preferable for dispensing most types of viscous liquids. While the invention prevents lower viscosity liquid from entering the portion of the container holding the viscous liquid, it does not prevent its discharge from the container. This invention is only useful for dispensing a few types of viscous liquids, is expensive to produce, and does not address the problem of lower viscosity liquid discharge.

In yet another type of package for dispensing viscous liquid, there is an opening designed to minimize accumulation of viscous liquid adjacent to the outlet of the container, as shown, for example, in U.S. Pat. No. 6,041,975. The upper surface of the cap, including the outlet through which viscous liquid is dispensed, is recessed in a portion of the container. The container has a flexible portion that can be squeezed for dispensing the product through the outlet. The upper surface of the container around the outlet can be modified to minimize accumulation of the viscous liquid outside the outlet. This invention does not address the accumulation of viscous liquid under the surface of the cap that exacerbates the problem of lower viscosity liquid discharge.

The inventions cited have various advantages and disadvantages with regard to dispensing viscous liquids, but none fully address the problem of lower viscosity liquid discharge from viscous liquid containers. Furthermore, they do not offer a cost-effective solution to the problem of viscous liquid buildup that impedes dispensing. Therefore, what is needed is a method of dispensing viscous liquid that prevents discharge of lower viscosity liquid and is manufactured with minimal cost.

SUMMARY OF THE INVENTION

Among the objectives of the present invention are to provide a cap to dispense viscous liquids from plastic containers without the accompaniment of lower viscosity liquid. The cap is compatible with plastic containers typically used to package viscous liquids. Caps currently in use for dispensing viscous liquids do not prevent the discharge of lower viscosity liquid that may have built up in the attached container. Ketchup packaging is an excellent example. Condensation and settling, common in viscous condiments like ketchup, produces a lower viscosity, or watery, liquid that sits on top of the viscous condiment. When a consumer desires to use a condiment and turns the container upside-down to dispense the desired condiment, the lower viscosity liquid is typically discharged prior to the condiment. This problem occurs most frequently after the condiment is stored and then re-used.

Improvements to caps used for dispensing viscous liquids have failed to remedy the discharge of lower viscosity liquid. Some of these caps have a recess around the dispensing outlet which may initially prevent watery discharge, but whose usefulness is diminished after initial use of the product. The recess is designed to collect lower viscosity liquid when the container is inverted, allowing the viscous liquid to be dispensed while the lower viscosity liquid is held in the recess. When a container holding viscous liquid is inverted, however, the viscous liquid with greater density penetrates the lower viscosity liquid and clings to the underside of the cap. As the container is returned to an upright position, some viscous liquid may remain adhered to the underside of the lid while the lower viscosity liquid drains back to the top of the product in the container.

The product adhering to the underside of the cap eventually becomes more viscous and may dry and harden, filling the recess area. When the container is next inverted for use, there is no recess to collect the lower viscosity liquid as it has been filled with viscous liquid adhered to the cap. As a result, the lower viscosity liquid, which moves more quickly than the viscous liquid, precedes the desired viscous liquid as it is dispensed.

When used to dispense viscous liquids, caps with concentric outlets are especially vulnerable to adhesion and recess blocking problems. The adhesive property, i.e. surface tension, of viscous liquids enables them to cling to a particular surface against the force of gravity. The adhesive property of viscous liquids increases as the size of the surface they cling to is reduced. A concentric opening breaks up the surface of a cap, creating smaller surface areas that increase the possibility of viscous liquid accumulation. When the surface tension and adhesion of the viscous liquid accumulated under the cap is greater than the pull of gravity, it will remain in the cap recess. The retention of the viscous liquid in the cap recess prevents the collection of the lower viscosity liquid the recess was designed to retain. As a consequence, the lower viscosity liquid has nowhere else to go and is dispensed prior to the desired viscous liquid.

The present invention comprises a cap with an eccentrically located outlet on the top side of the cap and an elongated tube or channel extending at an angle from the inlet on the underside of the cap to the outlet. A unique aspect of the present invention is the distance between the inside of the cap wall or container wall where the cap is attached on a plane parallel to the underside of the cap and the outer edge of the inlet of the tube or channel is greater than 10 millimeters. In other words, the distance between the projection of the opening of the Inlet tube onto the plane of the underside of the cap and the furthest point on the cap edge, which will coincidentally place the projection of the outlet opening onto the same plane between the furthest point on the cap edge and the projection of the inlet onto the inside surface, will be more than 10 millimeters. By having the edge of the inlet more than 10 millimeters from the cap edge, the distance lowers surface tension and decreases adhesion of the viscous liquid. This distance reduces the occurrence of viscous liquid buildup on the underside of the cap.

The present invention is also unique where the elongated tube or channel is preferably set at an angle, or the outlet and inlet are spaced from each other creating an angle to the vertical, to minimize collection of undesired lower viscosity liquid in the tube or channel as the container is angled for dispensing the higher viscosity liquid such as ketchup, mustard and the like. The position and angle of the elongated tube or channel create a larger area on which to collect and disperse the lower viscosity liquid as the desired viscous liquid is dispensed.

The objects of the present invention are met by providing a cap designed to eliminate the problem of lower viscosity liquid discharge when dispensing viscous liquids. The cap may be affixed to a variety of flexible plastic containers commonly used in dispensing viscous liquids and is manufactured with a minimum of cost and materials. Further objects and advantages of this invention will be made apparent in the following description, references being made to the accompanying drawings illustrating the preferred embodiment of the invention.

DETAILED DESCRIPTION OF THE PREFERRED EMBODIMENT

For the purposes of promoting an understanding of the principles of the present invention, references will now be made to one of the preferred embodiments of the present invention as illustrated in FIGS. 1–7 using specific language to describe the same.

Figure 1:
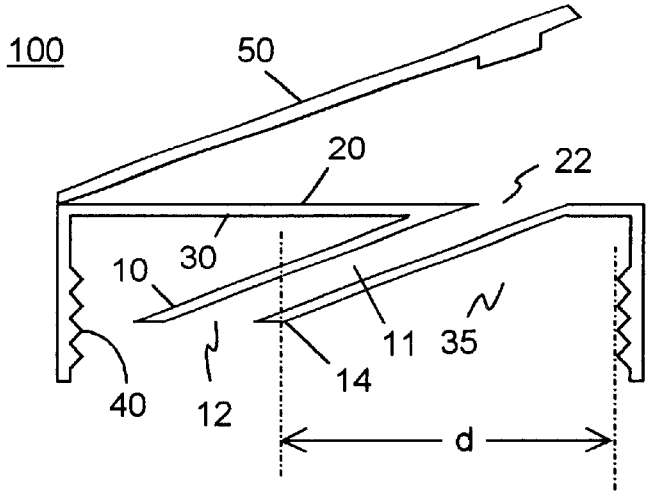
FIG. 1 is a cross-sectional view of a preferred embodiment of the present invention, showing an elongated tube extending from the underside of the cap at an angle, which tube is in communication with an outlet situated eccentrically in the surface of the cap.

FIG. 1 shows a cap 100 having a top surface 20, a bottom surface 30, an elongated tube 10, an inlet 12, an outlet 22, a wall portion 40, and a lid 50. Outlet 22 is located eccentrically in top surface 20 and is in communicative contact with passageway 11 of elongated tube 10. Elongated tube 10 is angled to bottom surface 30 such that inlet edge 14 is a pre-determined distance d from wall portion 40. Preferably, distance d is greater than 10 millimeters. Wall portion 40 generally has a securing component such as threads, a retaining edge and the like for securing cap 100 to a container (not shown). There is also defined a recess area 35 between inlet edge 14 and wall portion 40. Recess area 35 is designed to hold the lower viscosity liquid as the container is inverted for dispensing the desired viscous liquid so that the lower viscosity liquid cannot enter inlet 12 of elongated tube 10. To prevent accumulation of viscous liquid on bottom surface 30 in an amount that would effectively negate the benefits of the recess area 35 for holding the low viscosity liquid, the inlet edge 14 of inlet 12 must be at one point more than 10 millimeters from wall portion 40 on a plane parallel to the top surface 20 of cap 100. The placement of the inlet edge 14 of elongated tube 10 more than 10 millimeters from wall edge 40 is critical. It reduces the possibility that surface tension will create a situation where viscous liquids adhere to bottom surface 30 of cap 100, filling the space intended to receive the lower viscosity liquid, and causing the discharge of lower viscosity liquid with the desired viscous liquid. Condiments such as ketchup, mustard, and relish are examples of viscous liquids that are advantageously dispensed from cap 100, which is designed to prevent discharge of lower viscosity liquid.

Cap 100 is preferably a single molded piece made from a plastic material exhibiting the desired characteristics required for dispensing caps.

Elongated tube 10 is preferably between about 1 millimeter and 15 millimeters in length. Elongated tube 10 may extend into the container holding viscous liquid at an angle between about 5 and less than 90 degrees from outlet 22. Both inlet 12 and outlet 22 are of a size that permits the viscous liquid to enter and exit passageway 11 of elongated tube 10, preferably between about 3 to about 10 millimeters wide for circular-shaped channels. Inlet 12 is suspended in the attached container to collect the viscous liquid for dispensing and is preferably angled to assist in the collection of viscous liquid.

Wall portion 40 is preferably of a height that allows cap 100 to be attached to a container via a screwing or snapping method. Where wall portion 40 is to be screwed onto the container, it has threads molded into the plastic on the inside of wall portion 40. Alternatively, cap 100 may have a ridge on the inside of wall portion 40 along its circumference that allows cap 100 to be snapped over a receiving portion of the neck of a container.

In an alternative embodiment of cap 100 where the cap is press-fit into the neck of a container, wall portion 40 may be nonexistent. Regardless of the method of attachment, when cap 100 is attached to a container, it will form recess area 35 previously described.

Figure 2:
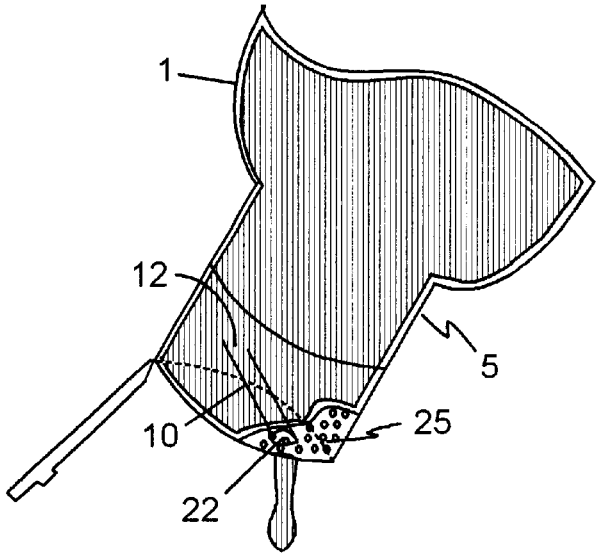
FIG. 2 is a perspective view of a preferred embodiment of the present invention attached to a condiment container showing where lower viscosity liquid is collected and disbursed in a recess area and desired viscous liquid is dispensed when the invention is attached to a container.

FIG. 2 shows a perspective view of a preferred embodiment of cap 100 attached to a container in a manner previously described in FIG. 1. FIG. 2 illustrates how lower viscosity liquid is collected within recess area 35 while the desired viscous liquid is dispensed through elongated tube 10. As the container is inverted, the lower viscosity liquid precedes the viscous liquid as they both travel down the lower side 5 of the container 1 toward outlet 22 of attached cap 100. The lower viscosity liquid settles in recess area 35 while the desired viscous liquid fills in the area on the underside of cap 100 until it reaches the level of inlet 12. With the undesired lower viscosity liquid trapped and dispersed in recess area 35, the viscous liquid enters inlet 12, fills passageway 11 of tube-like projection 10, and is dispensed through outlet 22. Inlet 12 is angled and positioned to take advantage of the customary method of dispensing a viscous fluid from containers having eccentrically located outlets.

Figure 3A:
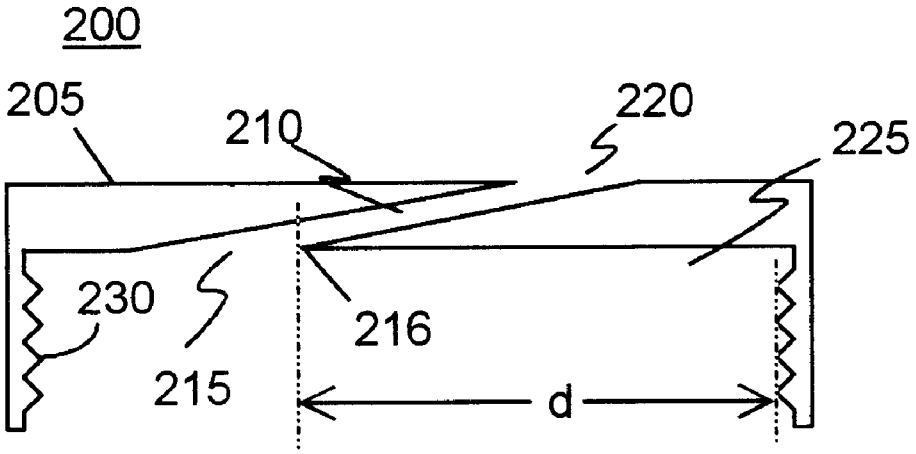
FIG. 3A is a cross-sectional view of another embodiment of the present invention showing a channel extending through a top portion of the cap from the outlet to the inlet at an angle.

FIG. 3A illustrates another embodiment of the present invention. FIG. 3A shows a cap 200 having a cap body portion 205, a wall portion 230, and a channel 210 extending through cap body portion 205 from an inlet 215 at an angle to an outlet 220. The outer edge 216 of inlet 215 closest to wall portion 230 on the side nearest outlet 220 is at least 10 millimeters from the wall. The area formed between outer edge 216 and wall portion 230 just described is recess area 225. Recess area 225 collects lower viscosity liquid while the desired viscous liquid is dispensed in the customary fashion as previously described in FIG. 1. As in FIG. 3A, viscous liquid is collected at inlet 215 and dispensed through outlet 220 of cap 200. Inlet 215, outlet 220 and channel 210 are preferably of a size that permits the higher viscosity liquid to be dispensed through cap 200. Wall portion 230 is preferably of a height and shape that allows cap 200 to be screwed or snapped onto a plastic container holding viscous liquid in the manner previously. Cap 200 may also be designed as an insert to be inserted such as by press fitting into the neck of a container. In such an embodiment, cap 200 may or may not have wall portion 230.

Figure 3B:
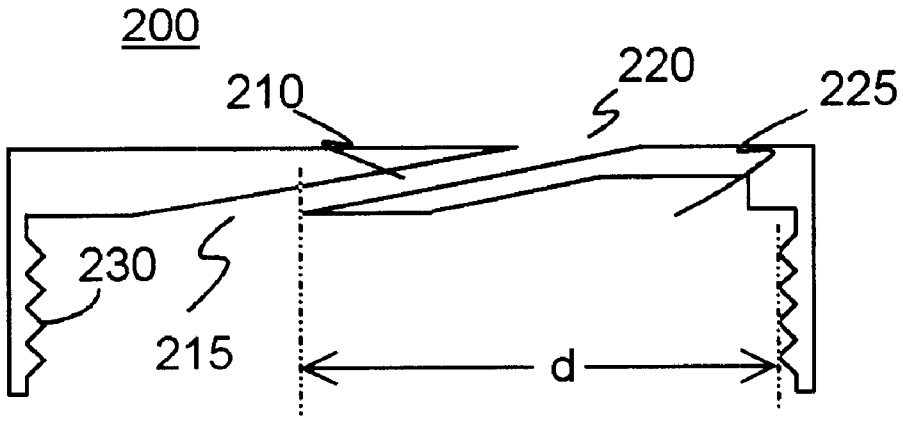
FIG. 3B is a cross-sectional view of another embodiment of the present invention illustrated in FIG. 3A showing a recessed portion on the underside of the top portion of the cap.

FIG. 3B is a modified version of cap 200 illustrated in FIG. 3A. Cap 200 has a cap body portion 205 that is thinner in recess area 225 than the rest of cap body portion 205. Causing cap body portion 205 to be thinner in this region provides for a larger volume of low viscosity liquid such as water to be collected in recess area 225, thus preventing the low viscosity liquid from being dispersed with the more viscous liquid such as ketchup, mustard and the like.

Figure 4:
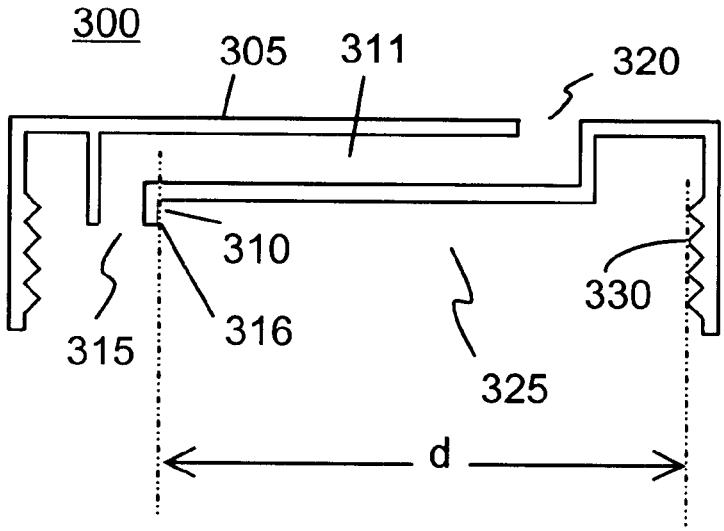
FIG. 4 is a cross-sectional view of another embodiment of the present invention showing a channel extending from the outlet on the top surface of the cap and cross the underside then downwardly.

FIG. 4 shows a cross-section of another embodiment of the present invention. FIG. 4 shows cap 300 having a top portion 305, a passageway 311 and wall portion 330. Passageway 310 forms a channel with two 90-degree turns from inlet 315 to outlet 320. Beginning at inlet 315, passageway 310 extends upwards for a length, preferably less than 15 millimeters, before turning approximately 90-degrees in a direction parallel to top portion 305 and toward the central axis of top portion 305. Passageway 310 continues pass the centerpoint of top portion 305 for a pre-determined distance such that the distance between inlet edge 316 and wall portion 330 is greater than ten (10) millimeters. This greater than 10 millimeter length will reduce the probability of viscous liquid adhering to the underside of cap 300 and filling recess area 325. Passageway 310 then makes a second 90-degree turn upwards through top portion 305 for a length preferably between about 1 to about 6 millimeters to outlet 320.

Recess area 325 collects lower viscosity liquid while the desired higher viscosity liquid is dispensed as previously described in FIG. 1. As in the previously mentioned embodiments, the higher viscosity liquid is collected at inlet 315 and dispensed through outlet 320 of cap 300. Inlet 315, outlet 320 and passageway 310 are preferably of a size that permits the higher viscosity liquid to be relatively easily dispensed from cap 300. Wall portion 330 is preferably of a length that allows cap 300 to be screwed or snapped onto a plastic container holding viscous liquid in the manner previously described.

Figure 5:
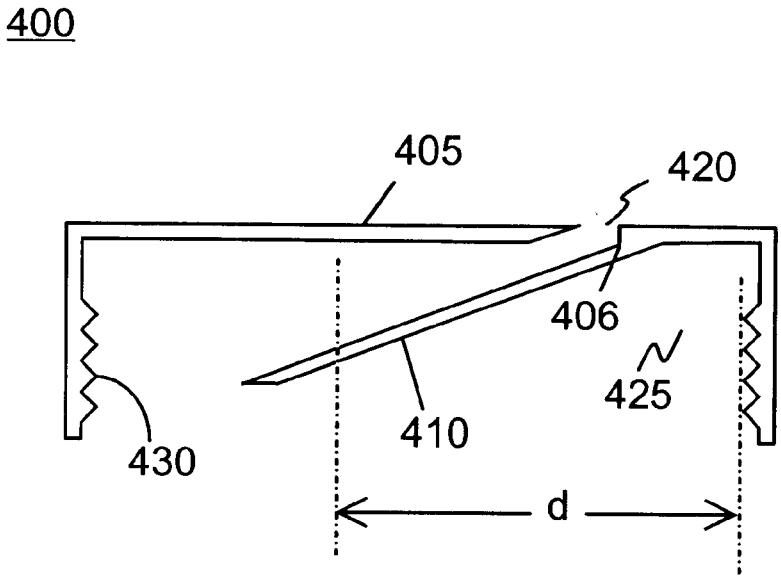
FIG. 5 is a cross-sectional view of another embodiment of the present invention showing an extending flange portion extending at an angle from the outlet.

FIG. 5 shows yet another embodiment of the present invention. Cap 400 has a top portion 405, an outlet 420, a flange portion 410, and a wall portion 430. Outlet 420 is located eccentrically in top portion 405. Flange portion 410 is shaped to fit within the neck of a container and is connected to top portion 405 at a point on the underside 406 of top portion 405 adjacent to outlet 420 and closest to wall portion 430. Flange portion 410 is angled away from wall portion 430 nearest outlet 420 creating recess area 425. When condiments such as ketchup, mustard and the like are dispensed from squeezable containers having a cap with an eccentrically located opening, the customary tipping of the bottle toward the outlet to dispense the desired condiment causes the lower viscosity liquid to collect within recess area 425.

Figure 6:
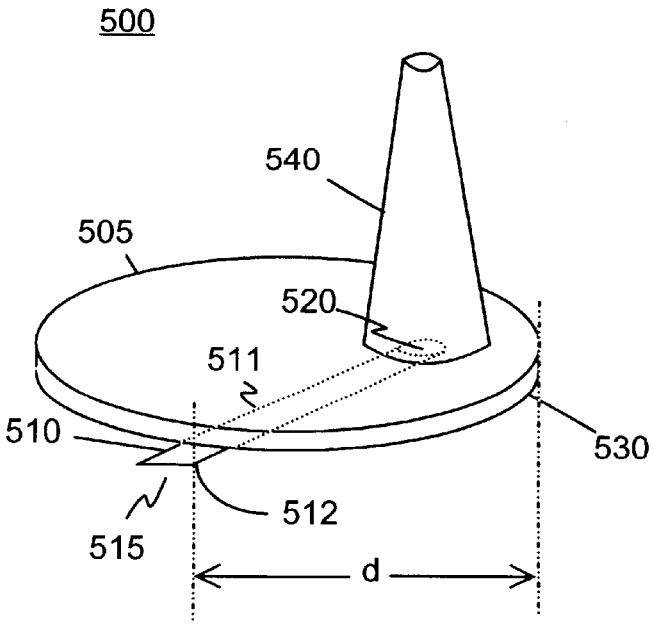
FIG. 6 is a perspective view of another embodiment of the present invention showing an elongated tube extending at an angle from the underside of a dispensing cap having a pull-up or screw-up spout protruding from and situated eccentrically in the topside of the cap.

FIG. 6 shows a perspective view of another embodiment of the present invention for use with external pull-up or twist-up spouts commonly attached to caps used in dispensing mustard and other highly viscous liquids. Cap 500 has a top portion 505, a spout 540, an outlet 520 situated eccentrically in top portion 505 and directly below spout 540, an inlet 515, and an elongated tube 510 having a passageway 511 between inlet 515 and outlet 520. Inlet edge 512 is situated more than 10 millimeters from the inner wall 530 on a diameter line parallel to top portion 505 running through the center of a projection of outlet 520 lying within the same plane as the diameter line. Elongated tube 510 extends at an angle from outlet 520 to inlet 515. Inlet 515 and outlet 520 are preferably of a size that permits the viscous liquid to enter and exit elongated tube 510, as previously described in FIG. 1.

Figure 7:
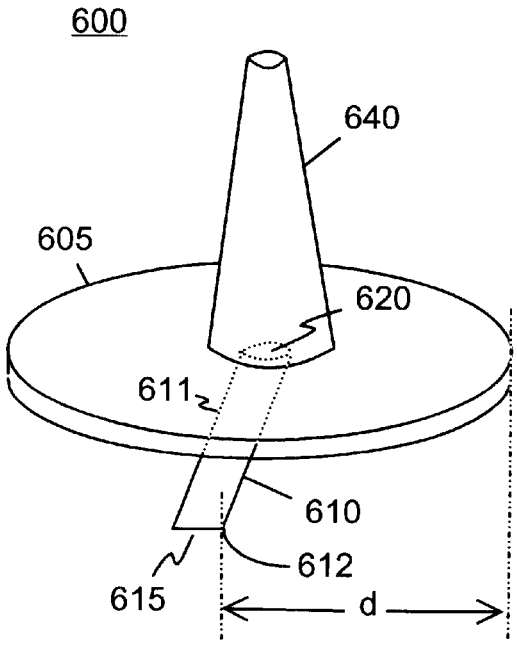
FIG. 7 is a perspective view of another embodiment of the present invention showing an elongated tube extending at an angle from the underside of a dispensing cap having a pull-up or screw-up spout protruding from and situated concentrically in the topside of the cap.

FIG. 7 shows a perspective view of another embodiment of the present invention for use with external pull-up or twist-up spouts as previously described in FIG. 6. Cap 600 has a top portion 605, a spout 640, an outlet 620 situated concentrically in top portion 605 and directly below spout 640, an inlet 615, and an elongated tube 610 having a passageway 611 between inlet 615 and outlet 620. Inlet edge 612 is situated more than 10 millimeters from the inner wall 630 on a diameter line parallel to cap top portion 605 running through the center of a projection of outlet 620 lying within the same plane as the diameter line. Elongated tube 610 extends at an angle from outlet 620 to inlet 615. Inlet 615 and outlet 620 are preferably of a size that permits the viscous liquid to enter and exit elongated tube 610, as previously described in FIG. 1. Twist-up or pull-up spout 640 extends upwards from top portion 605 of cap 600 away from outlet 620 and elongated tube 610.

It should be understood that the above description of the invention has been presented for purposes of illustration and no limitation of the scope of the invention is hereby intended. The terminology used herein is for the purpose of description and not limitation. Any modifications or variations in the above depicted method or device, and such further applications of the principles of the invention as illustrated herein, as would normally occur to one skilled in the art to which the invention relates are considered to be within the spirit of the invention.

What is claimed is:

1. A viscous-liquid dispensing cap comprising:

a top portion having an outside surface, an inside surface and an outlet in said outside surface; and a passageway having an inlet on one end and connected to said outlet on the other end, said inlet and said outlet being vertically and horizontally offset from each other and wherein said inlet is at least ten millimeters from a perpendicular axis located at a point on the circumference of said top portion that is closer to said outlet than said inlet, said passageway being acutely angled to said inside surface and having a length equal to or less than the length of said cap.

2. The cap of claim 1 wherein said passageway is an elongated tube.

3. The cap of claim 1 wherein said angle is between about 10 degrees to less than 90 degrees.

4. The cap of claim 1 wherein said top portion further includes a circumferential wall extending for a predetermined distance from said inside surface.

5. The cap of claim 1 wherein said passageway is sized to dispense viscous liquids.

6. The cap of claim 1 wherein said opening is concentric to said circumference of said inside surface.

7. The cap of claim 1 wherein said opening is eccentric to said circumference of said inside surface.

8. The cap of claim 1 further comprising a closing member for blocking said opening.

9. The cap of claim 8 wherein said closing member is hingedly attached to the circumference of said top portion.

10. The cap of claim 8 wherein said closing member is slidably connected to said top portion.

11. A viscous-liquid dispensing cap comprising a top portion having an elongated conduit therethrough wherein said elongated conduit has an inlet and an outlet, said inlet and said outlet being horizontally and vertically offset from each other, said inlet being at least ten millimeters from a perpendicular axis located at a point on the circumference of said top portion wherein said point on said circumference is closer to said outlet than said inlet, said elongated conduit being acutely angled to an inside surface of said top portion and having a length equal to or less than said cap.

12. The dispensing cap of claim 11 wherein an area of said top portion adjacent said outlet is thinner than the remainder of said top portion.

13. The dispensing cap of claim 11 further comprising a wall portion extending from the circumference of said top portion and extending from said inside surface.

14. The dispensing cap of claim 13 wherein said wall portion includes a retaining component for attaching said cap to a container.

15. The dispensing cap of claim 14 wherein said retaining component are threads.

* * * * *